US005590718A

United States Patent [19]

Bertossi

[11] Patent Number: 5,590,718

[45] Date of Patent: Jan. 7, 1997

[54] ANTI-FIRE SYSTEM FOR VEHICLES

[76] Inventor: Roberto Bertossi, Lungadige Campagnola, 2, Verona, Italy

[21] Appl. No.: 543,124

[22] Filed: Oct. 13, 1995

[30] Foreign Application Priority Data

Oct. 19, 1994 [IT] Italy ..... VR94A0087

[51] Int. Cl.[6] ..... A62C 3/07

[52] U.S. Cl. ..... 169/62; 200/61.45 R

[58] Field of Search ..... 169/62; 200/61.45 R

[56] References Cited

U.S. PATENT DOCUMENTS

| | | | |
|---|---|---|---|
| 3,630,288 | 12/1971 | Tiberti et al. | 169/62 |
| 3,688,846 | 9/1972 | Lease | 169/62 |
| 3,733,448 | 5/1973 | Brady | 200/61.45 R |
| 3,788,666 | 1/1974 | Kramer et al. | 169/62 |
| 3,798,399 | 3/1974 | Corporandy | 200/61.45 R |
| 3,865,192 | 2/1975 | Dunphy | 169/62 |
| 3,993,138 | 11/1976 | Stevens et al. | 169/62 |
| 4,060,004 | 11/1977 | Scholz et al. | 200/61.45 R |
| 4,986,365 | 1/1991 | Shieh | 169/62 |

*Primary Examiner*—Gary C. Hoge
*Attorney, Agent, or Firm*—Notaro & Michalos PC

[57] ABSTRACT

A fire extinguishing system for a vehicle or a boat having a fire extinguisher supplying a fire extinguishing substance through a nozzle to discharge the fire extinguishing substance. The fire extinguisher and nozzle may be spatially separated and connected by an elongated pipe. Additional nozzles may be connected with pipes to the fire extinguisher, or additional fire extinguishers and nozzles may be used instead. At least one valve is used to regulate the flow of the fire extinguishing substance through the pipes to the nozzles. The valve is controlled by at least one impact sensor which opens the valve when a collision of the vehicle with another object is detected by the sensor.

7 Claims, 3 Drawing Sheets

ANTI-FIRE SYSTEM FOR VEHICLES

FIELD AND BACKGROUND OF THE INVENTION

This invention concerns a fire extinguishing system, especially for motor vehicles and boats.

As a consequence of collisions with obstacles or with other motor-vehicles or boats, the risk of a fire is very high and frequent. Resulting fires can cause injury, and even death, to the driver and passengers, and severe damage to the vehicle itself.

SUMMARY OF THE INVENTION

A principal aim of this invention is to provide an anti-fire, or fire extinguishing, system for vehicles, that is capable of eliminating or at least drastically reducing the risk of a fire caused by collisions.

A further aim of this invention is to provide a selective anti-fire system, which can distinguish between sudden braking where no collision occurs, and stopping due to collision of the vehicle, to avoid accidentally activating the system when it is not needed.

Advantages of this invention are the high reliability of the system and the low costs of both manufacturing and installing the system in the vehicle.

Accordingly, these and further aims, which will be better explained in the following description, are achieved by a fire extinguishing system which can be installed in a vehicle and/or boat, having at least one fire extinguisher supplying a fire extinguishing substance to at least one nozzle through one pipe for each nozzle, each pipe having at least one valve to control the flow of the fire extinguishing substance through the pipe, and at least one impact sensor for opening each valve in case of a collision of the vehicle with another object.

Further features and advantages of this invention will be described in detail in the following description using examples which are not intended to be exclusive and which are given as an explanation of the accompanying drawings.

DETAILED DESCRIPTION OF THE PREFERRED EMBODIMENT

Figure 1:
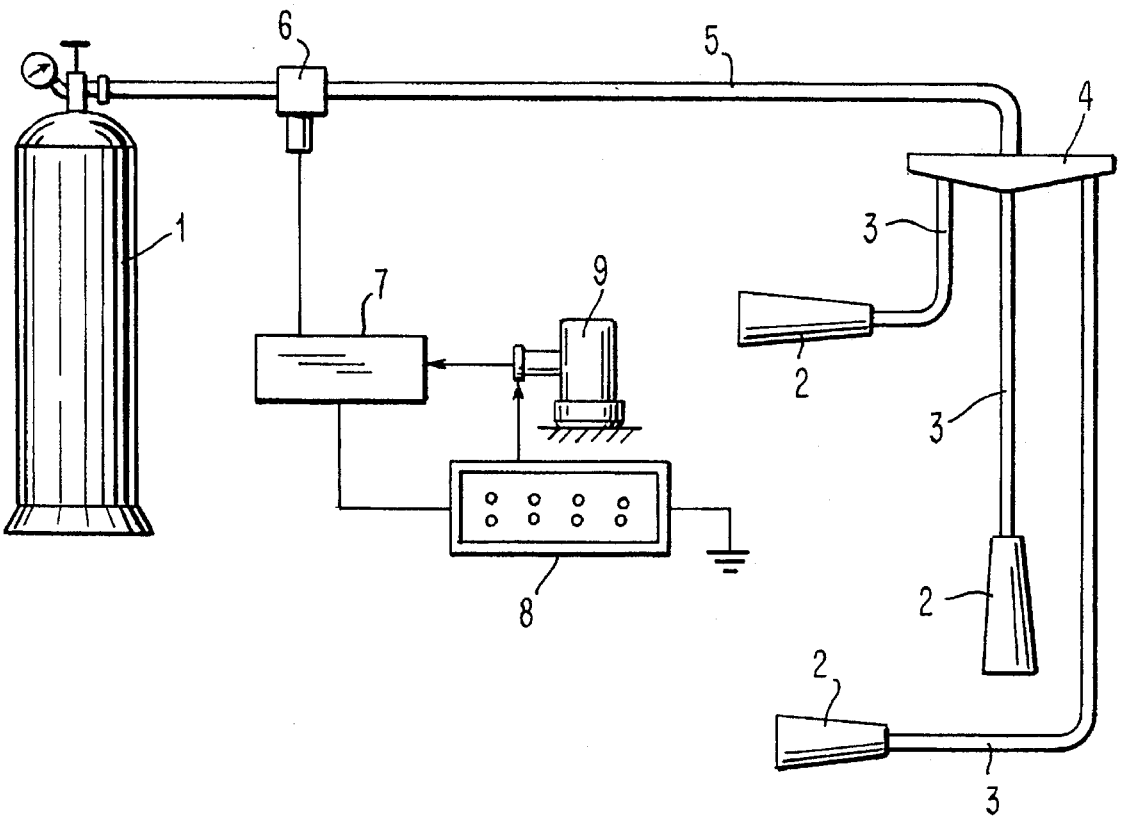
FIG. 1 is a schematic representation of a fire extinguishing system according to the invention.

Referring now to the drawings, in which the same or similar parts are marked with the same reference numbers, FIG. 1 shows a fire extinguisher 1, which contains a fire extinguishing substance. Extinguisher 1 may be any suitable type of fire extinguisher which is capable of supplying a fire extinguishing substance. Three nozzles 2 are shown connected to a manifold 4 by pipes 3. The manifold 4 is in turn connected to the fire extinguisher 1 through a feeding pipe 5.

A valve 6, such as an electrovalve, is installed to control the flow of the fire extinguishing substance through the pipe 5. The valve is placed on the feeding pipe 5, or between the feeding pipe 5 and the fire extinguisher 1, or on the fire extinguisher 1. The valve 6 can be opened and closed by a control board 7 powered by a battery 8. The battery 8 can be the battery of a vehicle on which the system is installed. One terminal of the battery 8 is connected directly to the control board 7, while the other terminal is connected with an inertial-type impact sensor 9. The impact sensor is appropriately calibrated to operate an integrated switch 10 when a collision between the vehicle and another object is detected, but not in the case of sudden braking of the vehicle.

Figure 2:
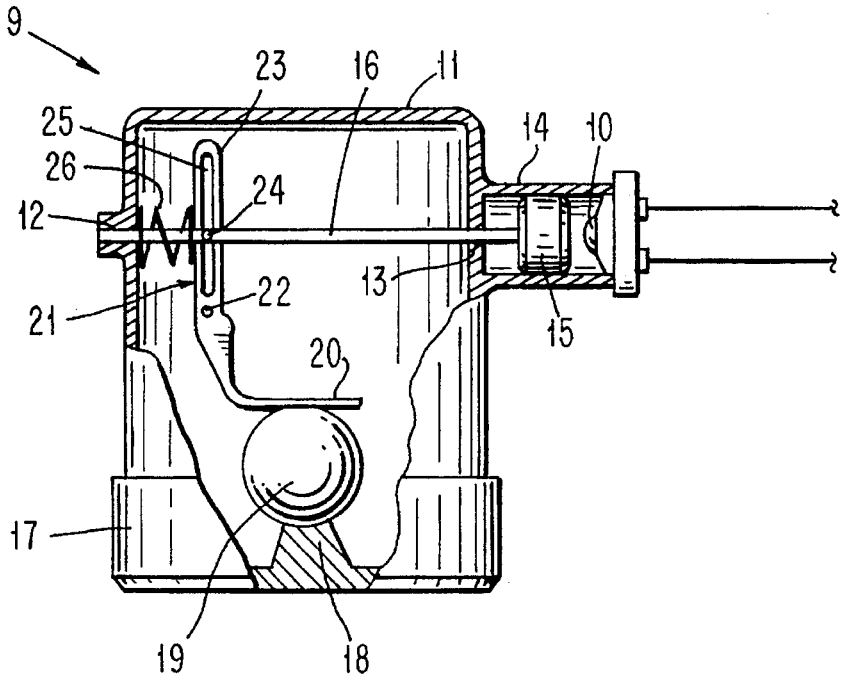
FIG. 2 is a sectional view of an inertial type impact-sensor, suitable for use with the system shown in FIG. 1.

As shown in FIG. 2, the impact sensor 9 can consist, for example, of a casing 11 with two diametrically opposed holes 12, 13. One hole 13 is connected with a portion of external overhanging pipe 14 which is integrated with the casing 11, or alternatively, the pipe 14 may be fixed to the casing. Inside the pipe 14, a sliding piston 15 is connected to a diametrical piston rod 16 whose ends are supported in the two holes 12, 13. Piston rod 16 can move within the holes when piston 15 slides inside pipe 14.

The lower part of the casing 11 is closed by a bottom 17, which can be attached to the casing 11, using, for instance, screw-type fasteners. Bottom 17 has an upwardly projecting cradle 18 holding a steel ball 19. The ball 19 is held in place on the cradle 18 by an elastic end 20 of a lever 21. The lever 21 has fulcrum 22 on the inner surface of the casing 11 and second end 23 is slidably secured to the piston rod 16 by pivot 24 through slit 25. Second end 23 is elastically loaded by a compression spring 26.

When the vehicle in which the system is installed collides with an obstacle with a sufficiently large impact, the force of inertia of the ball 19 exceeds the retaining force of the elastic end 20 of lever 21, causing ball 19 to fall off cradle 18. Elastic end 20 is calibrated to withstand a minimum magnitude of inertial force of the ball 19 to avoid accidentally triggering the sensor, such as in the case of sudden braking of the vehicle where no collision occurs. The ball 19 falling off of the cradle 18 releases the lever 21, which pivots, due to the unchecked expansion of the compressed spring 26, thereby causing the piston rod 16 and piston 15 to slide into contact with and close a switch or relay 10 located at the end of pipe 14. Closing the switch 10 causes the opening of the electrovalve 6, and the consequent discharge of the fire extinguishing substance through the nozzles 2 over the parts of the vehicle particularly subject to the risk of a fire, such as the engine, gas tank, interior of the vehicle, etc. In this embodiment, the fire extinguisher 1 is installed so that it is permanently open to valve 6, ready to supply the fire extinguishing substance to the system through the valve 6 as soon as valve 6 is opened.

Figure 3:
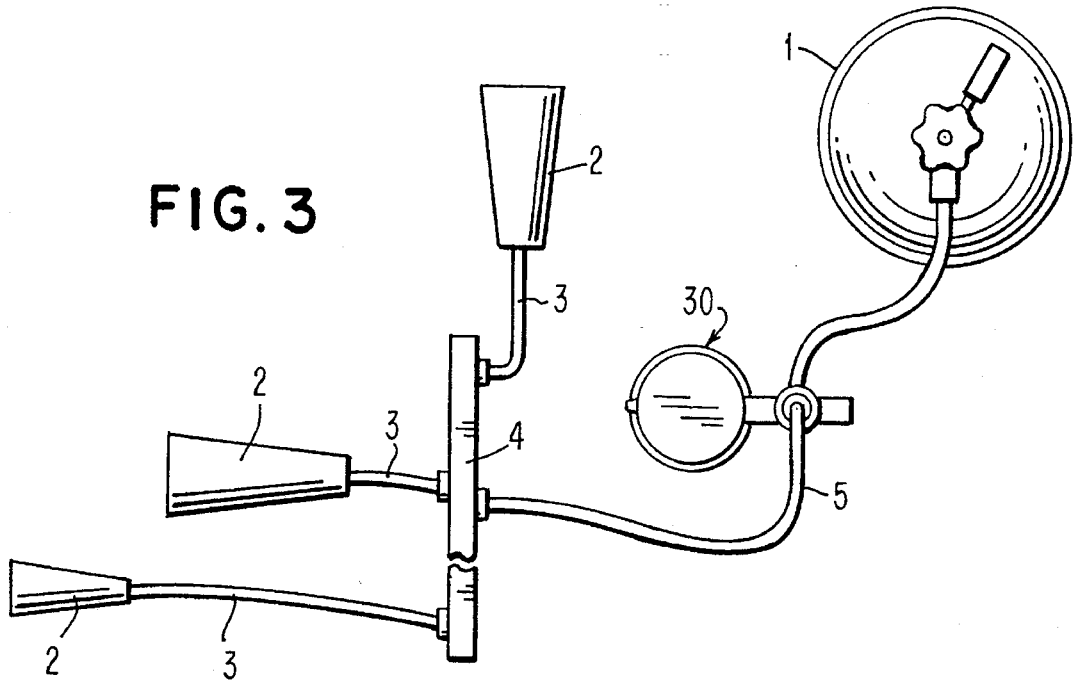
Fig. 3 is a top plan view of another embodiment of an fire extinguishing system according to the invention.
Figure 4:
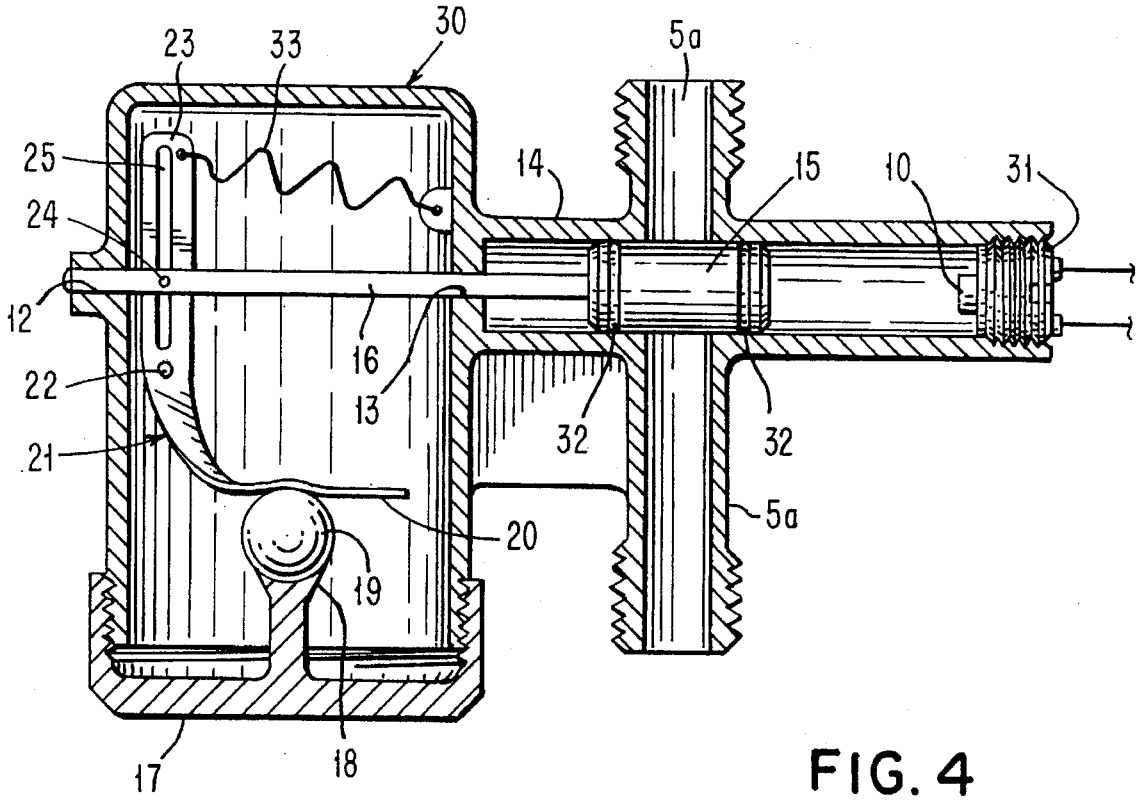
FIG. 4 is a longitudinal sectional view of an inertial type impact-sensor, suitable for use with the fire extinguishing system shown in FIG. 3.

In the embodiment shown in FIGS. 3 and 4, the fire extinguisher 1 is connected to an impact sensor 30 which includes an inertial valve controlling the flow of the fire extinguishing substance from fire extinguisher 1 through the pipe 5.

As shown in FIG. 4, the external pipe 14 is blocked at its far end by a plug 31 and intersected by transverse pipe 5*a*, which is connected between two sections of pipe 5. The piston 15 is long enough to block the transverse pipe 5*a*. Piston 15 is fitted with two O-rings 32 to ensure a tight fit within external pipe 14.

In operation, when the vehicle collides with an object with sufficient force, the piston 15 is caused to slide toward plug 31, over the transverse pipe 5*a*, providing an opening through which the fire extinguishing substance can pass to nozzles 2. The sliding motion of piston 15 is caused by traction spring 33 connected between casing 11 and second end 23 of lever 21 returning to its neutral state following ball 19 falling out of cradle 18. The spring pulls second end 23 toward hole 13 as lever 21 is allowed to pivot about fulcrum 22 when ball 19 is no longer present on cradle 18 to hold elastic end 20 of the lever 21 in place. The second end 23 of the lever 21 has slit 25 through which pivot 24 passes. Pivot 24 is connected to piston rod 16, and slides within slit 25 as lever 21 pivots, causing piston rod 16 and piston 15 to also slide toward plug 31.

In this embodiment, the fire extinguishing system does not require electrical power to operate properly.

Figure 5:
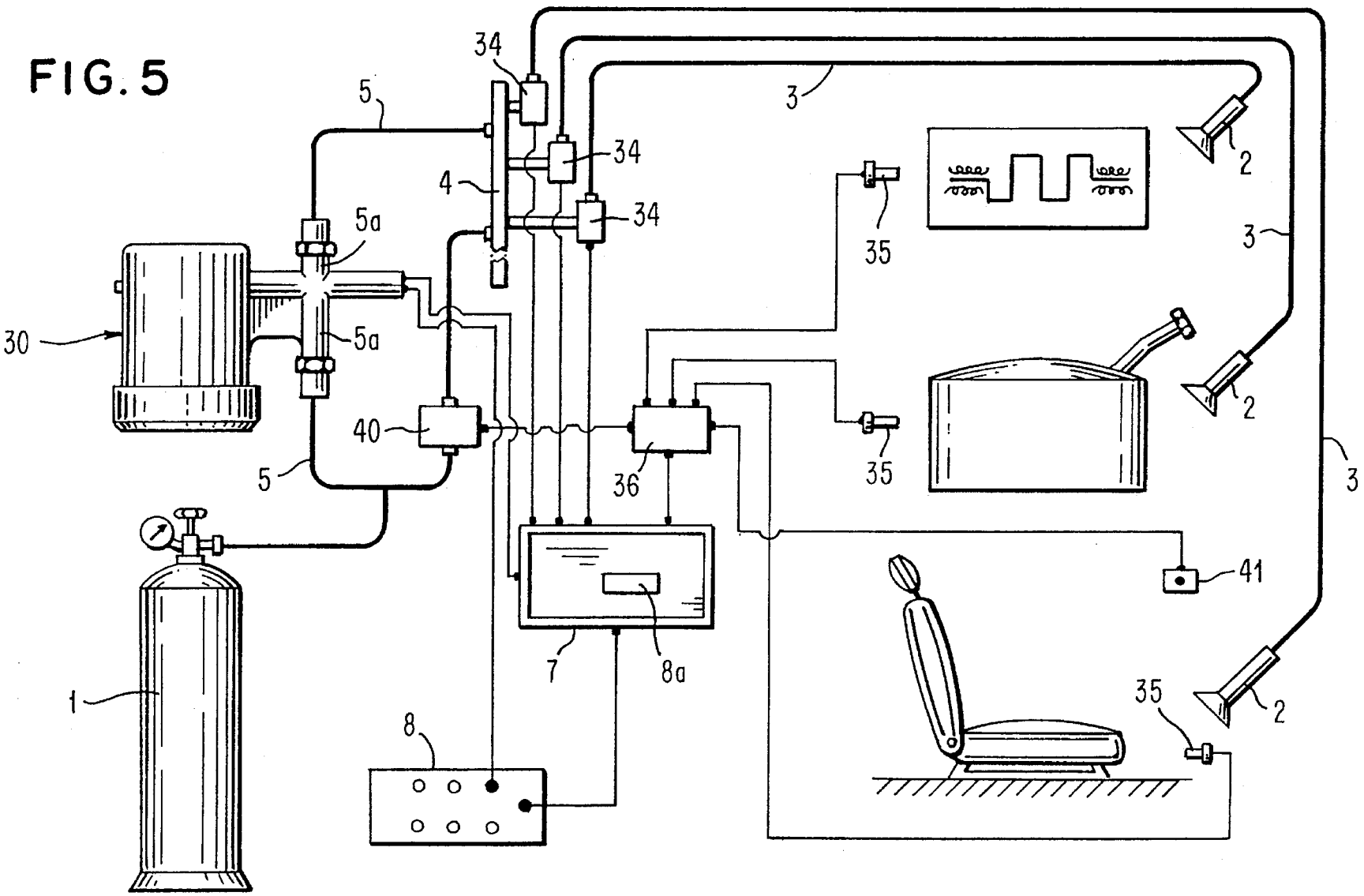
FIG. 5 is a schematic drawing of a further embodiment of the fire extinguishing system according to this invention.

FIG. 5 shows a further embodiment of a fire extinguishing system according to this invention. The system has an impact sensor 30, as shown in FIG. 4, having a switch 10 integrated with plug 31. An electrovalve 34 is placed between the manifold 4 and each pipe 3. A fire sensor 35 is located in the fire extinguishing substance distribution area of each nozzle 2. A fire sensor control board 36 is connected to each of the fire sensors 35, and which sends a signal to the control board 7 to open each electrovalve 34 which controls the supply to each nozzle 2 where a fire is detected by a fire sensor 35.

Each of the embodiments of the system as shown in FIGS. 1, 3 and 5 can include a hand control 41 (as shown in FIG. 5), which can be operated directly by the driver.

In FIG. 5, the fire extinguisher 1 supplies an electrovalve 40 from a branch of pipe 5, which is also connected to impact sensor 30. The outlet of electrovalve 40 is connected to manifold 4, which is used to distribute the fire extinguishing substance to each of the nozzles 2. The electrovalve 40 is controlled by the control board 7, and can be opened when one or more fire-sensors 35 send a signal to the control board 7 indicating the presence of a fire in the vehicle, and/or when the driver operates a hand control, such as a button or a switch 41, which is electrically connected to the control board 7. The switch 41 can be placed on the dashboard or anywhere in the interior of the vehicle near the drivers' seat. In this way, the fire extinguishing substance can be discharged in case of a fire which was not caused by impact or collision with an obstacles.

And in the case of a crash or impact, the pipe 5*a* inside the sensor 30 is automatically opened by the sliding of the piston 15. The piston 15 also makes contact with the switch 10 (as shown in FIG. 4) when it slides within pipe 14. When the switch 10 is contacted, it triggers the control board 7 to open each electrovalve 34, allowing the fire extinguishing substance to flow to each nozzle 2.

If desired, an auxiliary battery 8*a* can be installed in the control board 7 as a backup in an emergency. For example, in case the primary battery 8 is dead.

In any of the embodiments described above, the impact sensor 9, 30 is sensitive to impacts in any direction on a plane approximately parallel to the vehicle movement plane; therefore the impact sensor 9, 30 is sensitive to every kind of strong impact.

Further, rather than by means of the control board 7, the valve 6, of FIG. 1 can open as a consequence of a burst of any suitable type of pyrotechnic charge.

The fire extinguishing system may be further changed or varied in accordance with the objects of the invention and still be within the spirit of the invention.

I claim:

1. A fire extinguishing system which can be installed in a vehicle or a boat, the system comprising:

a fire extinguishing substance;

at least one fire extinguisher for containing and supplying the fire extinguishing substance;

at least one nozzle;

at least one distribution pipe connecting the at least one nozzle, to the at least one fire extinguisher;

at least one valve to control the flow of the substance through the at least one distribution pipe;

valve control means for opening each valve; and an impact sensor for activating the valve control means in case of a collision of the vehicle, the impact sensor comprising a casing having an interior, an exterior, and two diametrically opposed holes through the casing, one hole being in communication with an external pipe section connected around the hole to the outside of the casing; a sliding piston inside the external pipe; the valve control means being located inside the external pipe for opening each valve when activated by the piston; a piston rod, integrated with the piston, having two ends each end supported in one of the opposed holes; a bottom which can be fixed to the casing; an upright cradle projecting from the bottom; a weighted ball movably held in said cradle; a lever having a fulcrum on the interior of the casing, a lever elastic end in contact with and supported by the ball for flexibly maintaining the ball on the cradle, a lever second end which is slidably connected to the piston rod; and a tensioned spring connected to the lever second end for moving the lever second end when a collision occurs which causes the ball to fall out of the cradle, releasing the lever elastic end and allowing the lever to pivot about the fulcrum, which movement of the lever second end slides the piston rod and the piston within the external pipe, such that the piston activates the valve control means.

2. A system according to claim 1, further comprising the piston controlling an amount of fire extinguishing substance supplied through a section of feeding pipe connected between the at least one distribution pipe and the at least one fire extinguisher.

3. A system according to claim 1, wherein the at least one valve comprises at least one electrovalve, the system further comprising, an electrical power means for providing electrical power; a control board for controlling the at least one electrovalve, the control board electrically connected to the electrical power means; and a switch, operated by the piston and electrically connected to the control board, such that, when the switch is operated, the at least one electrovalve opens.

4. A system according to claim 3, further comprising at least one fire sensor connected with the control board.

5. A system according to claim No. 4, further comprising a secondary electrovalve on the outlet of the at least one fire extinguisher in parallel with the impact sensor, the secondary electrovalve being selectively controlled by the control board after receiving a signal from the at least one fire sensor, for supplying the fire extinguishing substance to the at least one nozzle independently of the collision of the vehicle.

6. A system according to claim 4, further comprising hand control means for opening the secondary electrovalve.

7. A fire extinguishing system for a vehicle, comprising:

a fire extinguishing substance;

at least one fire extinguisher for containing and supplying the fire extinguishing substance;

at least one nozzle;

at least one distribution pipe connecting the at least one nozzle, to the at least one fire extinguisher;

a first valve to control the flow of the substance through the at least one distribution pipe; a first valve control means for opening the first valve; an inertial impact sensor for activating the first valve control means in case of a collision of the vehicle, the impact sensor capable of sensing the collision independent of an angle or a direction of the collision;

a second valve to control the flow of the substance through the at least one distribution pipe; a second valve control means for opening the second valve;

at least one fire sensor located in proximity to the at least one nozzle, the at least one fire sensor for sensing a fire;

a control board connected with the at least one fire sensor and the second valve control means, the control board for selectively controlling the second valve control means to open the second valve controlling the flow of the substance through the at least one pipe connected to the at least one nozzle located h proximity to the at least one fire sensor which senses the fire.

* * * * *